US006826791B2

(12) United States Patent
Fromme

(10) Patent No.: US 6,826,791 B2
(45) Date of Patent: Dec. 7, 2004

(54) SPRING ELEMENT FOR BEDS OR CHAIRS

(75) Inventor: Heinrich Fromme, Schloss Holte-Stukenbrack (DE)

(73) Assignee: FROLI Kunststoffwerk Heinrich Fromme OHG, Schloss Holte-Stukenbrock (DE)

( * ) Notice: Subject to any disclaimer, the term of this patent is extended or adjusted under 35 U.S.C. 154(b) by 0 days.

(21) Appl. No.: 10/624,543

(22) Filed: Jul. 23, 2003

(65) Prior Publication Data

US 2004/0123384 A1 Jul. 1, 2004

(30) Foreign Application Priority Data

Jul. 31, 2002 (DE) ..... 202 11 765 U
Jan. 7, 2003 (DE) ..... 203 00 248 U

(51) Int. Cl.[7] ..... A47C 23/04

(52) U.S. Cl. ..... 5/247; 5/255; 5/253; 5/261; 5/719; 267/103

(58) Field of Search ..... 5/247, 253, 255, 5/261, 716, 719; 267/89, 103, 105, 110

(56) References Cited

U.S. PATENT DOCUMENTS 5,426,799 A * 6/1995 Ottiger et al. ..... 5/719
5,588,165 A 12/1996 Fromme
5,632,473 A * 5/1997 Dias Magalhaes Queiroz ..... 267/164
5,787,533 A * 8/1998 Fromme ..... 5/719
6,113,082 A * 9/2000 Fujino ..... 267/103
6,353,953 B1 * 3/2002 Tanaka et al. ..... 5/723
6,427,990 B1 * 8/2002 Hartmann ..... 267/158
6,477,727 B1 11/2002 Fromme

FOREIGN PATENT DOCUMENTS

EP 1 121 880 8/2001

* cited by examiner

*Primary Examiner*—Michael Trettel
(74) *Attorney, Agent, or Firm*—Burns, Doane, Swecker & Mathis, L.L.P.

(57) ABSTRACT

A spring element for supporting a seat cushion or mattress includes a base body adapted to be attached to a foundation member. The base body includes a plurality of spring arms. Attached to the base body is a support body which includes at least two support arms. The support body is rotatable relative to the base body about an axis to displace the support arms between a supporting position to limit the deflection of the spring arms, and a non-supporting position to exert no influence on the spring arms. Therefore, the flexibility of the spring element can be adjusted by rotation of the support body.

22 Claims, 9 Drawing Sheets

Fig. 4a
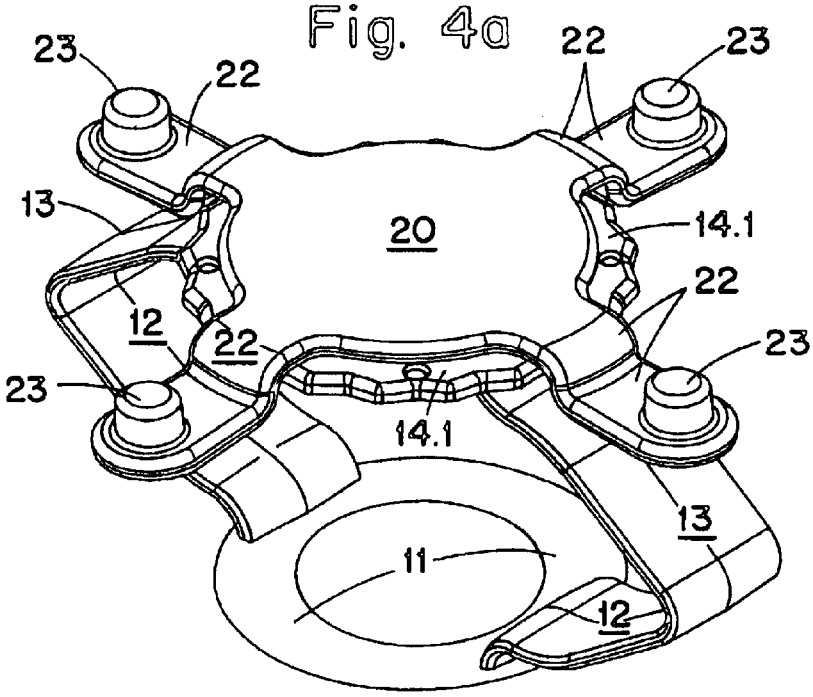
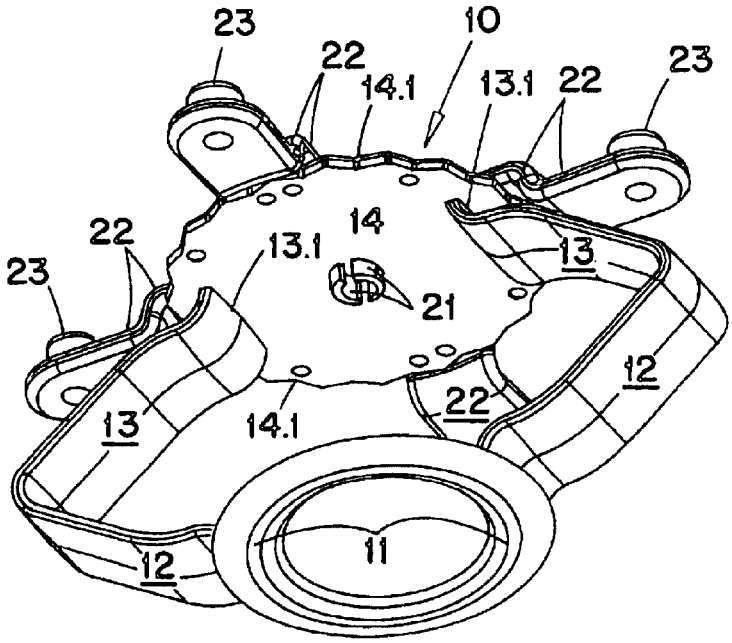
Fig. 4b

Fig. 5a
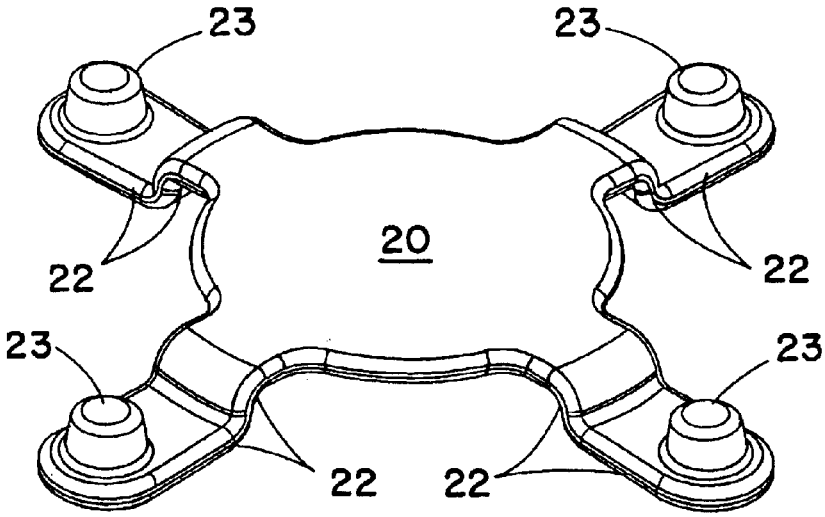
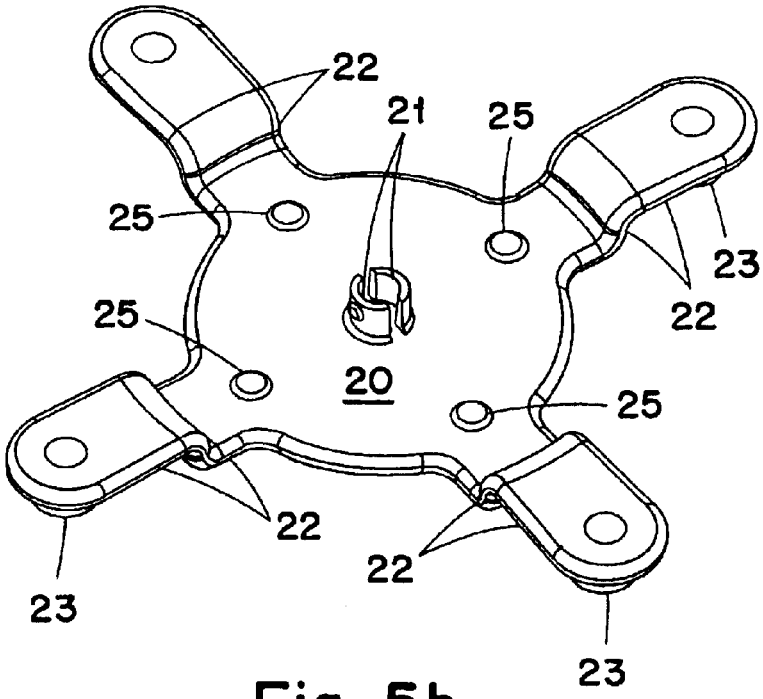
Fig. 5b

Fig. 6a
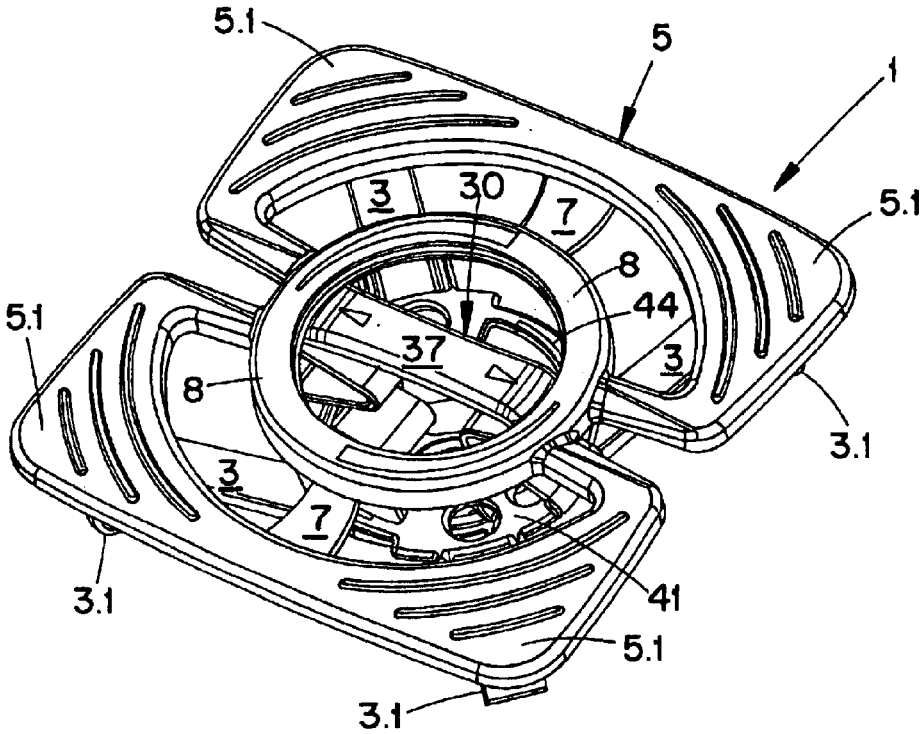
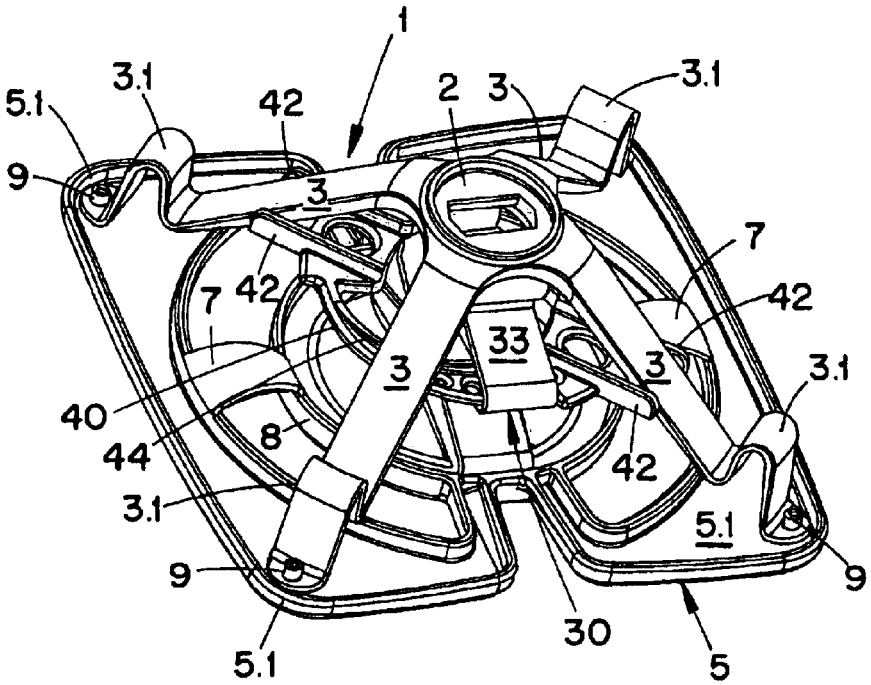
Fig. 6b

Fig. 9a
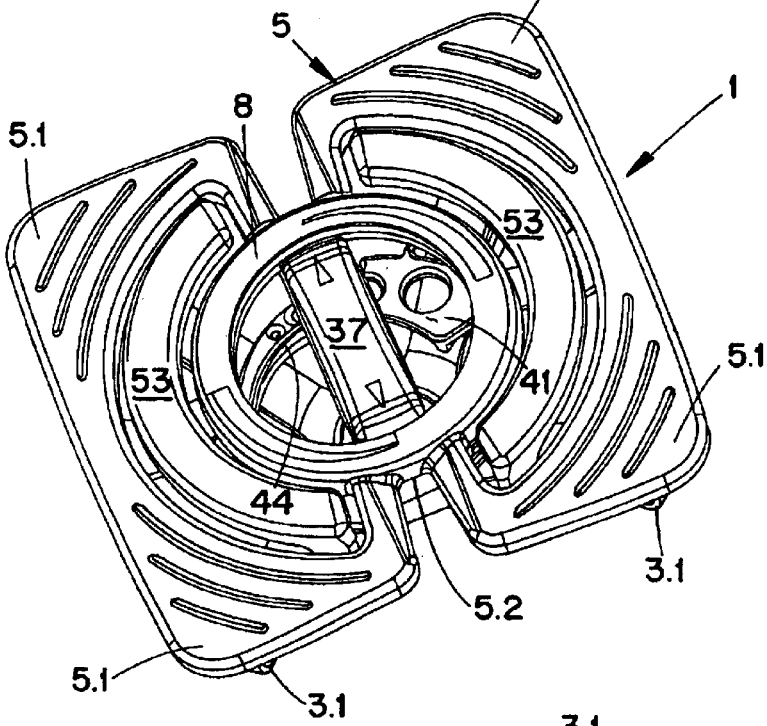
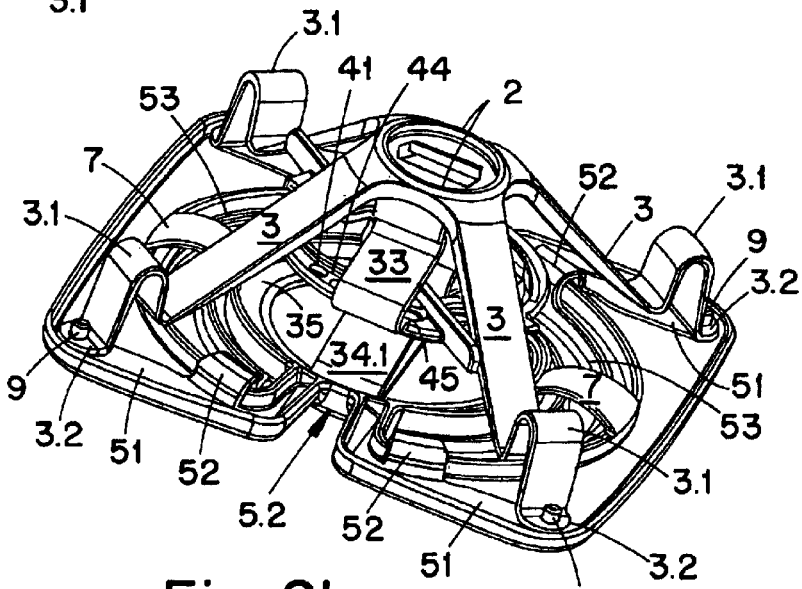
Fig. 9b

SPRING ELEMENT FOR BEDS OR CHAIRS

This application claims priority under 35 U.S.C. §§119 and/or 365 to U.S. patent application(s) Ser. No. 202 11 765.0 and Ser. No. 203 00 248.2 filed in Germany on Jul. 31, 2002 and Jan. 7, 2003, respectively, the entire content of which are hereby incorporated by reference.

BACKGROUND OF THE INVENTION

The present invention relates to a spring element for the supporting of sitting or reclining surfaces comprised of a base plate that can be attached on a foundation layer supported on which are at least two outwardly directed spring arms the free ends of which act in conjunction with a bearing disc support, and an auxiliary body is inserted between the base plate and the bearing disc support.

An upholstery element with a multitude of spring elements that are arranged in regular patterns is known in the art, for example, from DE-93 17 114 (corresponding to U.S. Pat. No. 5,588,165), which provides that each spring element is realized as a plastic part and equipped with a base plate and a head plate as well as with an elastic spring body that is arranged between the two former parts. Each spring element is attached to the foundation layer by way of its base part or a base plate in row and column arrangements. The head plates constitute the support surface for the upholstery element. Correspondingly, the spring elements cover-with the exception of the spring elements that are arranged in the edge and corner positions-in their entirety the sitting or reclining surface almost completely. When a load is applied, these spring elements are compressed; when the load is removed, the spring elements restore themselves to their previous state without further intervention. In order to be able to graduate the spring characteristics or to ensure safe restoration of the springs after extended use or overload, DE-93 17 114 proposes an internal support body that is arranged inside the spring element. However, to modify the spring characteristics, it is necessary to exchange the support body with another; graduated or continual adjustment action of the spring characteristics is not possible in this way.

Therefore, the object of the present invention consists in further developing the present spring element, notably in such a way that its hardness can be adjusted at least gradually, while economically sensible manufacture should be ensured.

SUMMARY OF INVENTION

This object is achieved by a spring element for the supporting of sitting and reclining surfaces. The spring element comprises a base body and a support body. The base body includes a base plate adapted to be attached to a foundation member, a bearing disc support for the supporting of sitting and reclining surfaces, and spring arms interconnecting the base plate and the bearing disc support. The spring arms are spaced apart to define at least two gaps. The support body is positioned between the base plate and the bearing disc support and includes a bearing ring support seated on the base plate, and at least two support arms extending from the bearing ring support. The support body is rotatable about an axis relative to the base body to displace the support arms between a supporting position adjacent respective spring arms to limit the deflection thereof, and a non-supporting position wherein the support arms are disposed in respective gaps.

The elastic support body that is inserted into the spring element features a bearing ring support that serves to support the support body on the base plate of the spring element. In this context, the bearing ring support on the base plate of the spring element can be freely rotated. Thus, the support body can assume any angled position relative to the spring element. Correspondingly, the opening of the ring element of the bearing ring support is envisioned in such a way that a cut-out is reserved that is intended for the means to fasten the spring element on the foundation layer. This way, it is possible to insert the auxiliary body of the support element already in advance as a preparatory measure during the manufacture of the spring elements.

Arranged on said bearing ring support are support arms equipped with radial, outwardly directed crowns, which are realized as pointing outwardly and modeled as a kind of leaf spring in a V- or U-shape; and the free ends of the support arms are combined to form a support disc that, acting in conjunction with the bearing disc support, supports the bearing ring support. Advantageously, the elastic support body has at least two support arms.

In a first embodied example, the curvature corresponds to the spring arms of the spring element. This way, the hardness of the cushioning of the spring element is influenced by the positioning of the support arms of the support element relative to the spring arms of the spring element. In the one extreme position, where the spring arms of the spring element are aligned with the support arms, the latter make contact providing support to the spring arms when a load is applied to the spring element, thereby reducing the elastic flexibility of the spring arms and thus increasing the hardness of the spring element. If, on the other hand, the support body is arranged in the other extreme position, the support arms of the support body are arranged at a gap relative to the spring arms of the spring element, thereby not having the ability to make contact in order to support the spring arms. Consequently, the magnification of the hardness of the spring element is not achieved, and the spring element exhibits a lower degree of hardness. In the present context, obviously, the spring element can also be used even without this support body in which instance it would exhibit its original hardness. Furthermore, obviously, it is possible to adjust any intermediate values.

In a preferred further development, the bearing disc support is designed to receive a disc attachment that is securely connected to the bearing disc support of the spring element, for example, by way of positive locking means. Advantageously, a disc attachment of this type is equipped with projecting arms that act in conjunction with the bearing disc support. For this purpose, the projecting arms and the corresponding, inwardly pointing parts of the bearing disc support feature nose-like protrusions and indentations and/or recesses that secure the position of the disc attachment relative to the bearing disc support of the spring element, when both act in conjunction.

In a second embodied example, an adjusting disc is arranged inside the support body, notably in such a manner that it engages in the crowns of the U- or V-shaped realizations of the support arms. Ridges are envisioned for each of the support arms close to the periphery of the adjusting disc; and these ridges rise from the surface of the support disc, increasing in height, and act in conjunction with their corresponding sections in the way of "inclines," thereby elevating these sections from their standard positions and modifying their spring hardness. Correspondingly, said adjusting disc is securely connected to two spring arms of the spring element that are arranged opposite to each other, which results in the supporting body being rotated relative to the adjusting disc. The ridges that are modeled as an incline are now acting as an adjusting organ for the spring hardness in that they lift the end arms of the support spring to a higher or lesser degree, thereby preloading them.

Advantageously, it is possible to adjust at least these two extreme positions in that the support disc and the bearing disc support feature stops that limit the two extreme positions. In order to be able to adjust and secure intermediate positions in these embodiments, thereby being able to adjust and secure additional angled positions of the support body relative to the spring element, the disc attachment is rotated relative to the support disc; all the while, the support insert and the spring element are equipped with means that act in conjunction creating a lock when engaged, for example, in the form of nose-like protrusions and the corresponding indentations or recesses. If a nose-like protrusion engages such an indentation, it is secured in that position, and said position can only be changed when the nose is removed from this indentation by applying a certain force that results in an elastic deformation of the parts. This way, by way of rotating the support body relative to the spring element, it is possible to change the degree of hardness of the spring element between the minimum value and the maximum value.

Advantageously, the nose-like protrusions are arranged in a circle; and one of the plates, either the support disc or the bearing disc support, features at least one nose-like protrusion, while the other disc, either the support disc or the bearing disc support, features a multitude of nose-like protrusions that are arranged at least in the shape of a segment of a circle and cover up the adjustment range.

In a further development, in an effort to improve the back-ventilation, the bearing disc support is equipped with means that lift the unloaded mattress; means of this kind are known in the art from DE-200 01 616 (corresponding to EP 1 121 880—the disclosure of which being incorporated by reference). In the present embodied examples, the bearing disc support features recesses in the shape of a segment of an arc that receive the mattress lifters. The lifters are equipped with fastening arms arranged at their end positions that, on their part, are secured in conjunction with the spring arms of the spring element on the bearing disc support of the latter. This way of inserting the mattress lifters allows for a particularly easy and economic manufacture.

BRIEF DESCRIPTION OF DRAWINGS

The objects and advantages of the invention will become apparent from the following detailed description of a preferred embodiment thereof in connection with the accompanying drawings and in which like numerals designate like elements.

FIG. 1*a*: support arms aligned with spring arms,

FIG. 1*b*: support arms at a gap with spring arms.

FIG. 2*a*: support arms aligned with spring arms,

FIG. 2*b*: support arms at a gap with spring arms.

FIGS. 4*a*, 4*b*: support body, first embodied example, with disc attachment.

FIG. 4*a*: top view isometry,

FIG. 4*b*: bottom view isometry.

FIGS. 5*a*, 5*b*: disc attachment, first embodied example;

FIG. 5*a*: top view isometry;

FIG. 5*b*: bottom view isometry.

FIGS. 6*a*, 6*b*: spring element, second embodied example of invention with support body;

FIG. 6*a*: top view isometry,

FIG. 6*b*: bottom view isometry.

FIG. 7*a*: support insert complete, isometric representation,

FIG. 7*b*: support body, isometric representation.

FIG. 7*c*: adjusting disc, isometric representation.

FIGS. 9*a*, 9*b*: spring element, second embodied example with mattress lifter;

FIG. 9*a*: top view isometry,

FIG. 9*b*: bottom view isometry.

DESCRIPTION OF PREFERRED EMBODIMENTS OF THE INVENTION

Figure 1A:
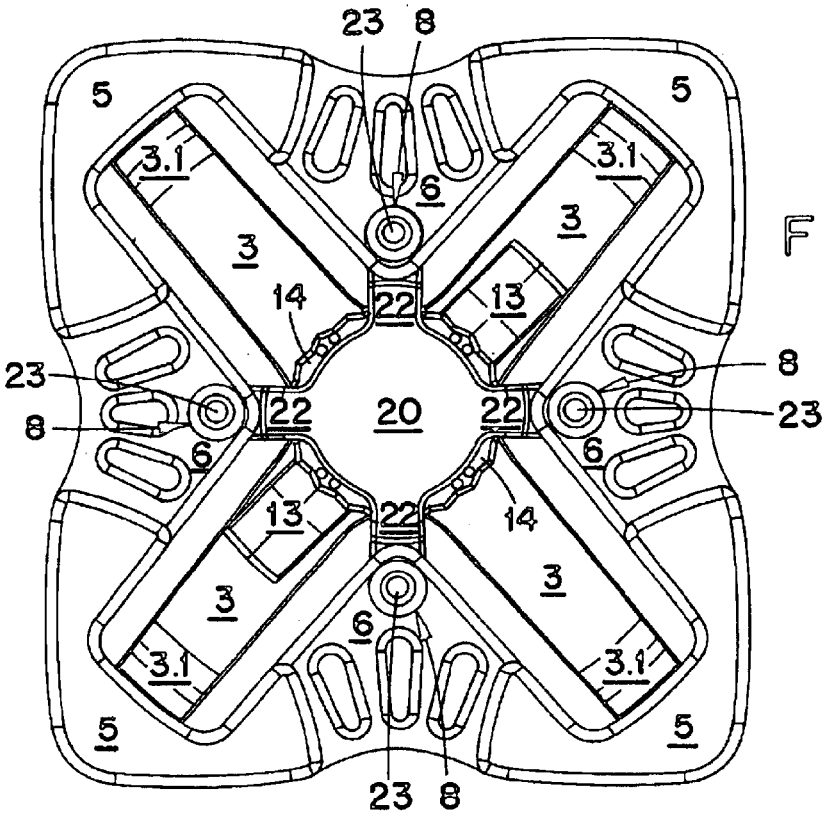
FIGS. 1*a*, 1*b*: spring element, first embodied example of invention with support body, top view.
Figure 1B:
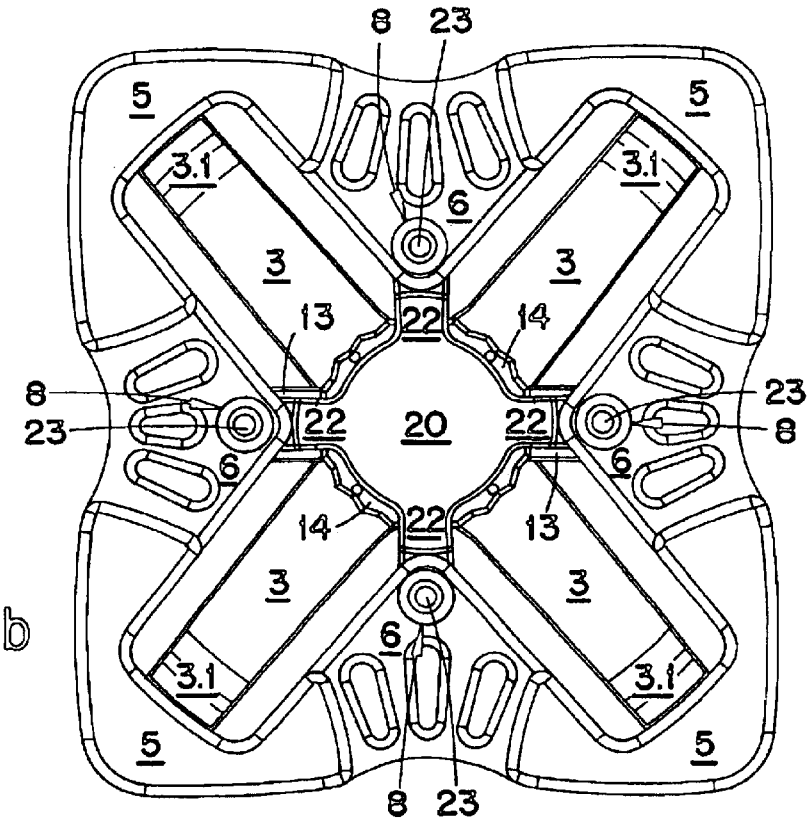

Described hereinafter are two preferred embodiments of the invention shown in FIGS. 1*a* through 5*b* and FIGS. 6*a* through 10, respectively.

First Embodiment:

Depicted in each of FIGS. 1*a*, 1*b*, 2*a*, and 2*b* is a spring element 1 which includes a base body of conventional configuration, and a support body 10 according to the invention which enables the degree of hardness of the base body to be adjusted. The support body 10 itself is depicted in FIGS. 3, 4*a* and 4*b*. A disc attachment part 20 which connects the support body to the base body is itself depicted in FIGS. 5*a* and 5*b*.

The conventional base portion of the spring element 1 that is known, for example, from DE-297 21 655, (corresponding to U.S. Pat. No. 6,477,727) features a base plate 2 that serves to place and support the spring element 1 on a foundation layer (not shown in further detail). This foundation layer can consist of a plate or—as is the case with a grid of slats—a number of slats that run parallel relative to each other and are arranged at equal distances from each another. First, outwardly directed spring arms 3 extend from the base plate 2 of the spring element 1 that are equipped with an ondular washer part 3.1 and modeled to which are their fastening ends 3.2. Placed upon these fastening ends 3.2 is a bearing disc support 5 that is aligned approximately parallel in relation to the base plate 2 and features openings allowing for a back ventilation of the mattress that is placed on top of it (not shown in further detail). Advantageously, the bearing disc support is subdivided and equipped with surfaces in the end position 5.1 that are connected via the intermediate parts 5.2 to one another relative to the bearing disc support 5.

In the first embodied example, the support body 10, which can be used to adjust the degree of hardness of the spring element, is arranged inside the base body. Via a bearing ring support 11, this support body 10 is placed upon the base plate 2. Fastening elements envisioned in the central area of the base plate are freely accessible through the opening of the bearing ring support 11. Support arms 12 extend outwardly from the bearing ring support 11, and these support arms 12 are adjusted in terms of their curvature relative to the spring arms 3 at least in the area of the outwardly directed arm parts. At approximately the half-way point, the support arms 12 are bent toward the center forming the end arms 13, and their free ends 13.1 transition into a support disc 14 that is arranged on the central axis of the spring element 1.

A disc attachment 20 is envisioned in order to obtain a connection to the bearing disc support of the spring element 1. The bearing disc support 14 is equipped with a central bore hole 15 in order to receive this disc attachment 20, and the central peg 21 of the disc attachment engages in said bore hole. Advantageously, this central peg is slotted allowing for it to be inserted into the bearing disc support 14 with a preload that is possible due to the slotting.

Moreover, this disc attachment 20 has projecting arms 22 that are equipped with pegs 23 in the end positions. The intermediate parts 6 that form, in conjunction with the surfaces in the end position 5 of the spring element 1 the bearing disc support of the latter, feature openings 8 that receive these pegs 23. This way, the disc attachment 20 is fastened relative to the bearing disc support, while the support body 10 can be freely rotated relative to the disc attachment 20.

To be able to rotate the support body 10 relative to the spring element 1 in order to adjust it for the purpose of changing the degree of the hardness of the spring element 1, the support disc 14 is equipped with an adjustment edge 14.1 that is modeled as a non-skid edge. Support disc 14 and disc attachment 20 feature friction locking means acting in conjunction with each other that are arranged on opposite sides of each other. In FIG. 3 the locking means are displayed in the way of an example as adjustment openings 16 in the support disc 14 and adjustment protrusions in the form of pegs 25 disposed on the bottom side of the disc attachment 20. The pegs 25 are receivable in respective openings 16 to hold the support body at least weakly (frictionally) in respective positions of angular (rotary) adjustment. However, the realization of the locking means is not restricted to the above example. In this context, obviously, locking means of this kind can, in the alternative, also be envisioned between the base plate 2 of the spring element and the bearing ring support 11.

With the assistance of this combination of adjustment nose-like protrusions 25 and adjustment openings 16 it is possible to rotate and adjust the support body, that is otherwise freely movable on the base plate 2 of the spring element 1 as well as relative to the disc attachment 20, in such a way that its support arms 12 are aligned with the spring arms 3 of the spring element when brought into one of their extreme positions (shown in FIGS. 1*a* and 2*a*), while, when brought into the other extreme position (shown in FIGS. 1*b* and 2*b*), the support arms 12 are displaced by 90 degrees into respective gaps formed between adjacent spring arms 3 of the spring element 1. Moreover, intermediate positions of adjustment between the two extreme positions are also possible. The adjustment is achieved by way of rotating the support body 10 relative to the spring element 1, and in the "correct" (desired) position, one of the adjustment nose-like protrusions 25 respectively of the disc attachment 20 engages in one of the adjustment openings 16 of the support disc 14 of the support body 10, thereby creating a tactile marker of this position.

Figure 2A:
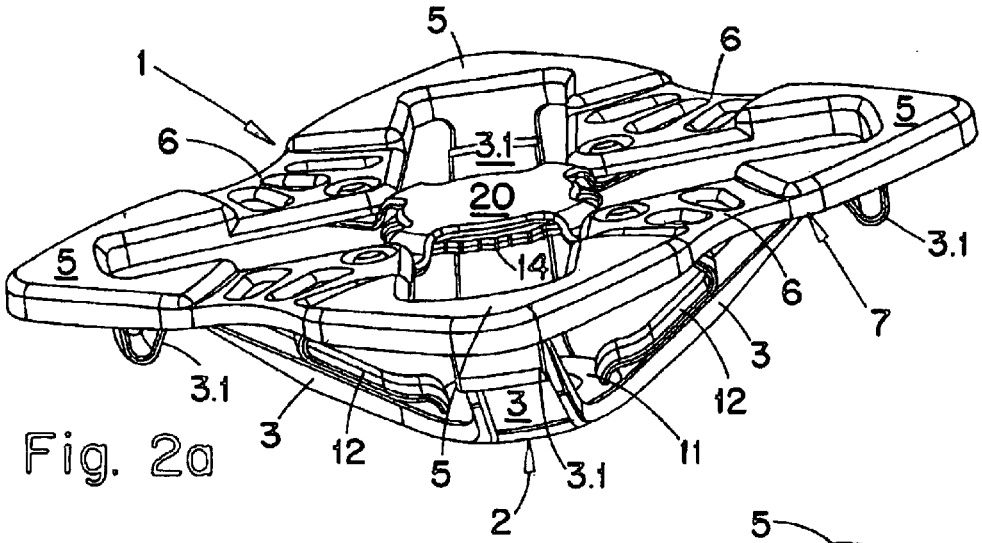
FIGS. 2*a*, 2*b*: spring element in accordance with FIG. 1, top view isometry.
Figure 2B:
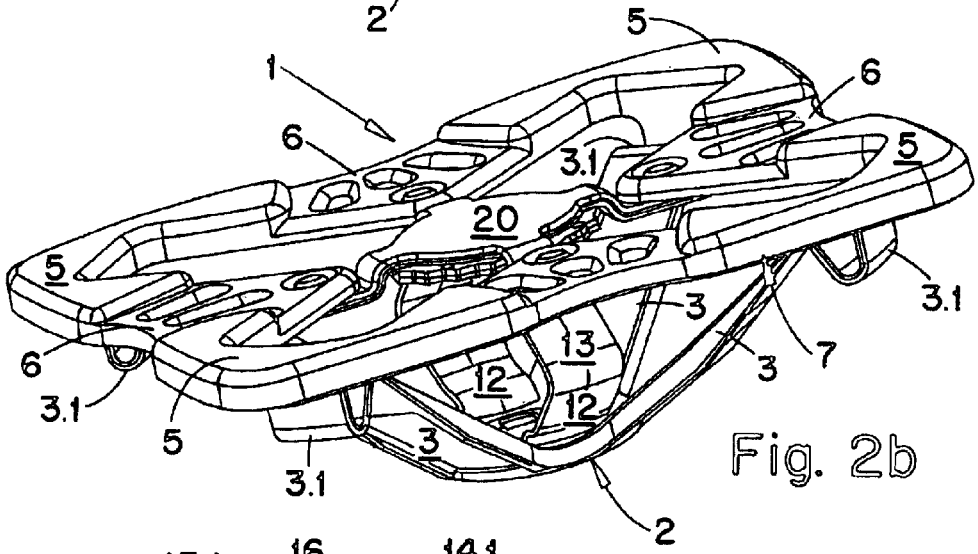
Figure 3:
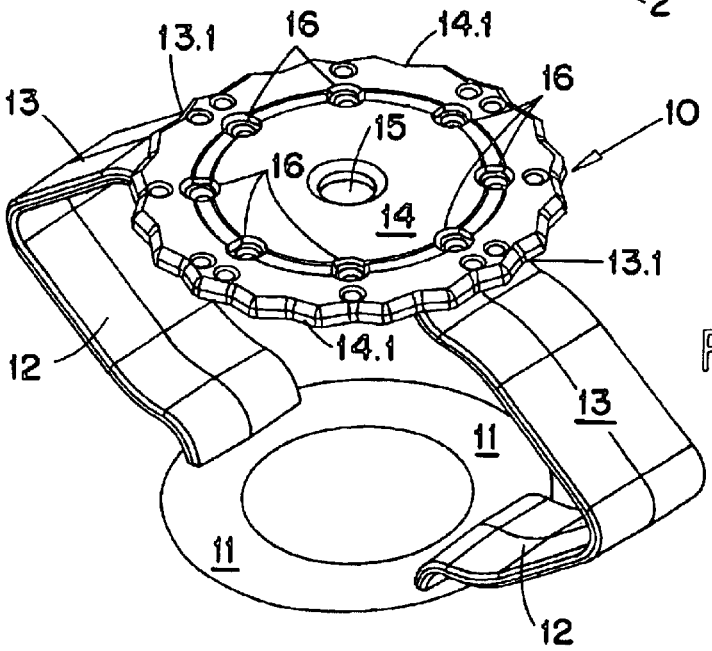
FIG. 3: support body, first embodied example, top view isometry.
Figure 7A:
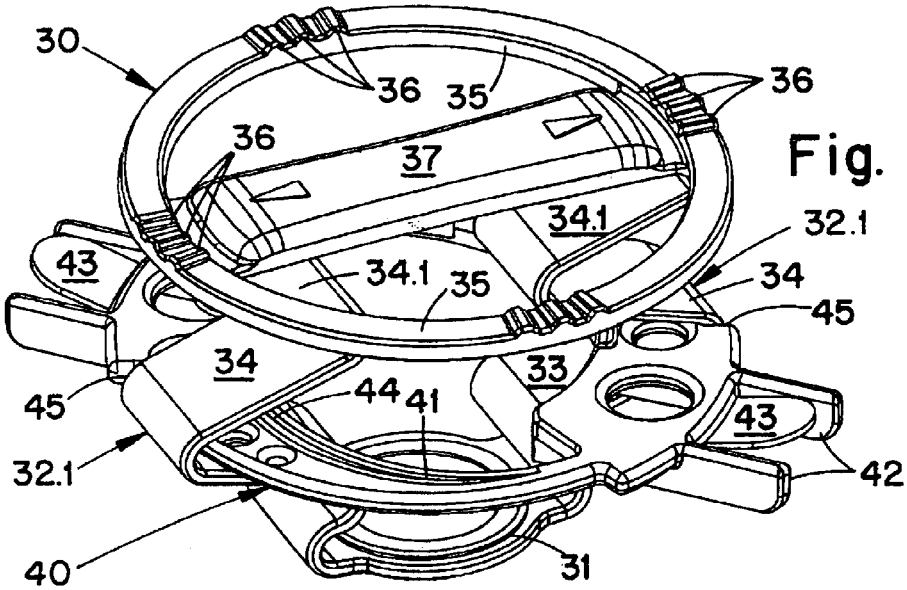
FIGS. 7*a*, 7*b*, 7*c*: support body, second embodied example.
Figure 7B:
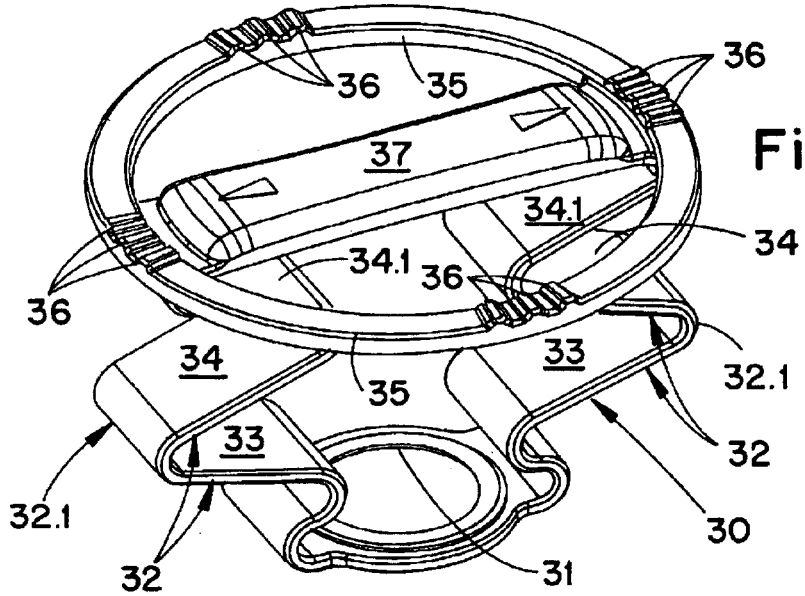
Figure 7C:
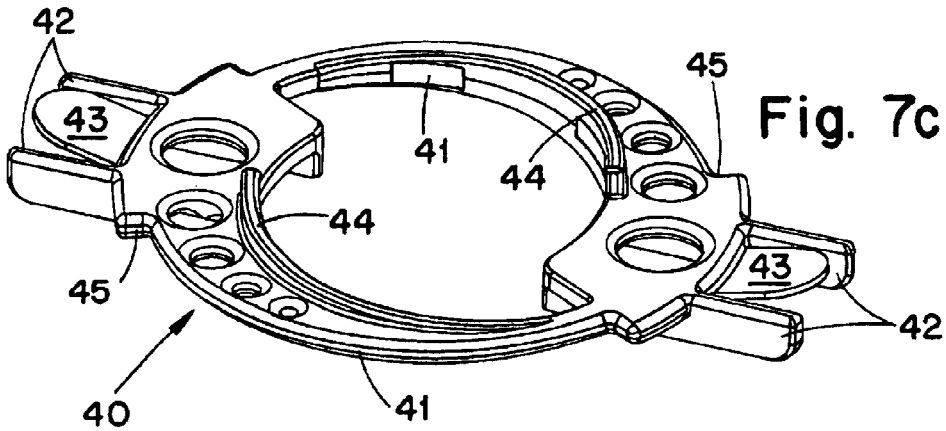
Figure 8:
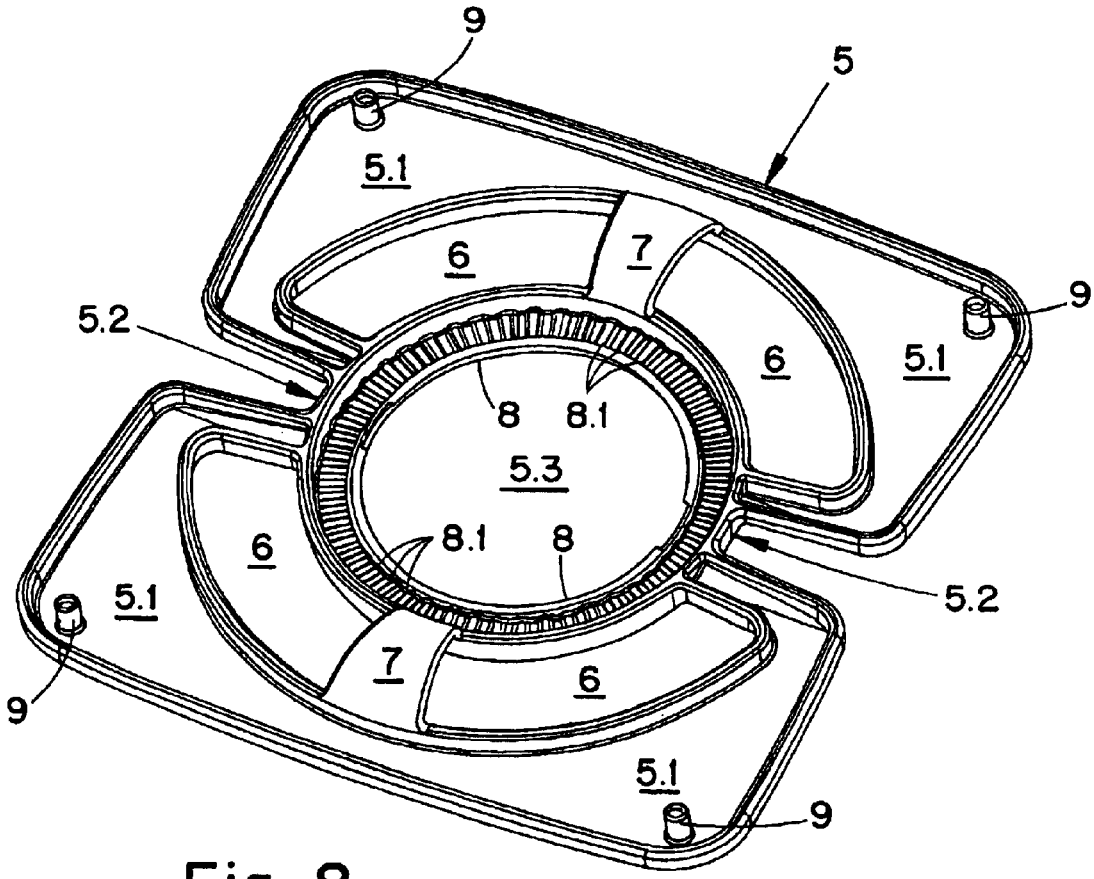
FIG. 8: bearing disc support, second embodied example, bottom view.

When the support body 10 is in the FIGS. 1*a*, 2*a* position, the support arms 12 can be abutted by the respective spring arms 3 during compression of the spring element under load, as the spring arms tend to bow toward the support arms. This serves to increase the hardness of the spring elements. In contrats, when the support arms are in the FIGS. 1*b*, 2*b* position, they cannot be abutted by the bowing spring arms, whereby the spring element exhibits less hardness.

Second Embodiment

A second preferred embodiment of the invention disclosed in connection with FIGS. 6*a* through 8, includes a base portion 1A that is somewhat similar to the base body described above, and the parts thereof will be referenced below by the same numerals but having a suffix "A".

In the second embodied example (FIGS. 6*a* through 8), the support body 30, which allows for adjusting the hardness of the spring of the spring element 1A, is arranged inside the spring element 1A, while the construction of the spring element essentially corresponds to the construction of the previously described spring element. For this purpose, a support body 30 of the second embodied example is inserted in the spring body that is formed by the spring arms 3A. This support body 30 rests with its bearing ring support 31 on the base plate 2A of the spring element 1A. Two support springs 32 extend from said bearing ring support that are outwardly bent approximately in a V-shape resulting in the formation of crowns 32.1 that are directed toward the outside. The part of the support spring 32 pointing toward the bearing ring support 31 forms the support arm 33, the part pointing toward the bearing disc support 5A forms the end arm 34, and the free ends of the latter 34.1 are connected to the ring support 35 carrying the latter.

A bearing ring support 8A rests against this support ring 35 limiting the internal central opening 5.3A. In the embodied example that is shown, the bearing ring support features at least in some areas locking nose-like protrusions 36 that act in conjunction creating a friction lock with the openings or tooth gaps of the teeth 8.1A that are envisioned in the bearing ring support 8A. Advantageously, an adjustment toggle 37 is envisioned in this support ring. Using the adjustment toggle 37, it is possible to simply rotate the support body 30 relative to the spring element 1A allowing for the adjustment to be easily carried out from above.

An adjusting disc 40 is inserted in the support body 30 featuring an adjusting ring 41. The holding devices 42 are arranged on this adjusting ring corresponding to two spring arms 3A that are arranged opposite each other, and the holding devices 42 hold the adjusting disc 40 in place preventing any rotation. A spring tongue 43 presses against the support arm 33 providing a hold. The adjusting ring 41 is equipped with an adjusting ridge 44 that projects from the surface of the adjusting ring and rises in the way of an incline to a certain height above said surface. This adjusting ridge rests against the inside of the end arm 34 and effects the support of the latter causing further hardness to be added to the spring system (i.e., reduced flexibility) with increasing ridge height, which is why the hardness of the spring of the spring element 1A increases. The desired adjustment remains secured during this process, because the locking nose-like protrusions 36 act in conjunction with the teeth 8.1A of the bearing crown support 8A in the sense of a locking connection.

Figure 10:
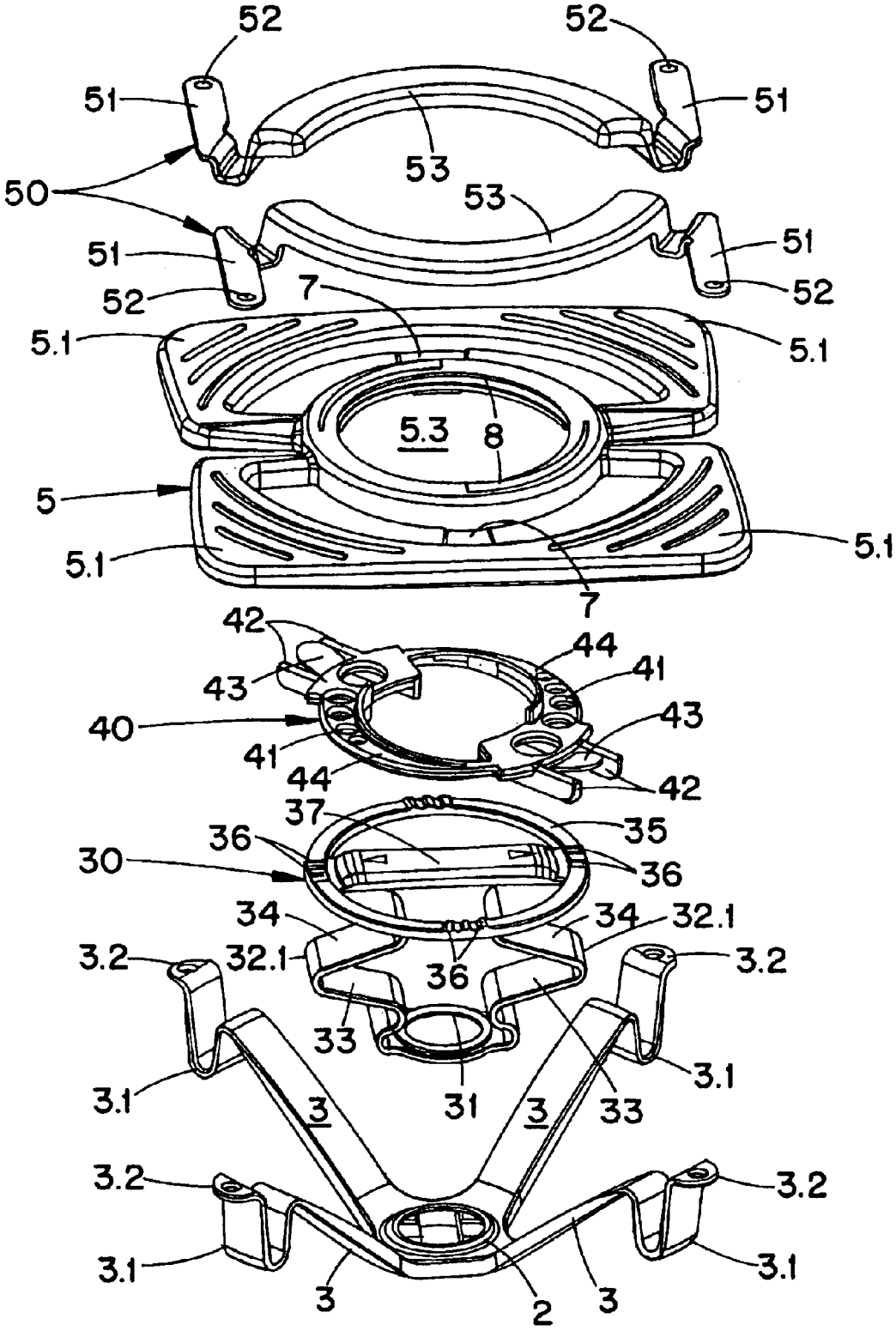
FIG. 10: spring element, second embodied example further including a mattress lifter, exploded view.

Mattress Lifter:

It is also possible to provide the spring element 1, 1A with a mattress lifter for lifting an unloaded mattress to provide for improved back-ventilation (as is known from DE 200 01616). FIGS. 9*a* through 10 depict such a mattress lifter 50 in combination with the second embodiment of the spring element 1A described in conjunction with FIGS. 6*a* through 8.

To receive the mattress lifter 50, the bearing disc support 5A features recesses 60 shaped as the arc of a circle; in the representation two recesses 60 are arranged opposite each other taking up approximately one semi-circle. To stabilize the ring parts of the bearing disc support 5A located on the outside, these parts are connected via holding links 7A to the inside part of the bearing disc support 5A that is realized as bearing ring support 8A; and these holding links 7A are arranged in such a way that the lifter backs 53, which are located inside the recesses 60 overlie these holding links 7A. Reset arm springs 51 are modeled to the lifter back 53 by way of hoop-like projections that transition into arm springs 51. The ends of these arm springs 51 feature the openings 52. Using these openings 52, it is possible to attach the arm springs 51 to the fastening pins 9A that are arranged in the corner areas of the surfaces 5.1A in the end position of the bearing disc support 5A. Advantageously, the fastening pins 9A are the same fastening pins that are also used to attach the end surfaces 3.2A of the spring arms 3A of the spring element 1A.

Although the present invention has been described in connection with preferred embodiments thereof, it will be appreciated by those skilled in the art that additions, deletions, modifications, and substitutions not specifically described may be made without departing from the sprit and scope of the invention as defined in the appended claims.

What is claimed is:

1. Spring element for the supporting of sitting and reclining surfaces, comprising:

a base body including a base plate adapted to be attached to a foundation member, a bearing disc support for the supporting of sitting and reclining surfaces, and spring arms interconnecting the base plate and the bearing disc support, wherein the spring arms are spaced apart to define at least two gaps; and a support body mounted on the base body and including at least two support arms, the support body being rotatable about an axis relative to the base body to displace the support arms between a supporting position adjacent respective spring arms to limit the deflection thereof, and a non-supporting position wherein the support arms are disposed in respective gaps.

2. The spring element according to claim 1, wherein the support body includes a bearing ring support seated on the base plate, the support arms extending from the bearing ring support.

3. The spring element according to claim 2 wherein the support body includes a support disc disposed adjacent the bearing disc support; each support arm including a first arm portion extending from the bearing ring support in a direction away from the axis, and a second arm portion extending inwardly to the support disc from an outer end of the first arm portion.

4. The spring element according to claim 3, further including a disc attachment for attaching the support body to the spring body, the disc attachment including projecting arms each having a protrusion engaged in respective openings of the bearing disc support, the disc attachment further including a central peg rotatably mounted in a central opening of the support disc.

5. The spring element according to claim 4 wherein the projecting arms correspond in number to the spring arms.

6. The spring element according to claim 1 further including a locking mechanism for frictionally locking the support body in respective rotational positions thereof.

7. The spring element according to claim 6 wherein the locking mechanism comprises angularly spaced protrusions in one of the base body and the support body and angularly spaced openings in the other of the base body and the support body.

8. The spring element according to claim 2 wherein the bearing disc support includes a recess, a mattress lifter including a lifter back disposed in the recess and a spring for biasing the lifter back out of the recess in a direction away from the bearing ring support.

9. The spring element according to claim 8 wherein the mattress lifter includes two arc-shaped lifter backs disposed in respective arc-shaped recesses formed in the bearing disc support, the spring comprises two arm springs connecting the lifter backs to the bearing disc support.

10. The spring element according to claim 9 wherein the bearing disc support includes a plurality of pins, each pin being connected to an end of an arm spring and to an end of a spring arm.

11. The spring element according to claim 1 wherein the support body is formed of plastic.

12. The spring element according to claim 1 wherein the spring body is formed of plastic.

13. A spring element for the supporting of sitting and reclining surfaces, comprising:

a base body including a base plate adapted to be attached to a foundation member, a bearing disc support for the supporting of sitting and reclining surfaces, and spring arms interconnecting the base plate and the bearing disc support, wherein the spring arms are spaced apart to define at least two gaps;

a support body positioned between the base plate and the bearing disc support and including a bearing ring support seated on the base plate, a support ring disposed adjacent the bearing ring support and at least two support arms extending from the bearing ring support to the support ring, the support body being rotatable about an axis relative to the base body to displace the support arms between a supporting position adjacent respective spring arms to limit the deflection thereof, and a non-supporting position wherein the support arms are disposed in respective gaps; each support arm including a first arm portion extending outwardly from the support disc in a direction generally away from the axis and toward a plane of the support ring, and a second arm portion extending from an outer end of the first arm portion in a direction generally toward the axis and toward the plane of the support ring, the first and second arm portions together forming an apex facing toward the axis; and an adjusting disc disposed inside of the spring arms and the support arms and being connected to the spring arms in a manner preventing rotation of the adjusting disc relative to the base body, the adjusting disc extending into the apexes of the support arms, the adjusting disc including arc-shaped adjusting ridges projecting toward the support ring and gradually increasing in height in a circumferential direction with reference to the axis to provide a support for engagement with the second arm sections of the support arms to reduce the flexibility thereof when the support arms have been rotated to their support positions.

14. The spring element according to claim 13 wherein the adjusting ring includes diametrically opposite pairs of projections extending generally radially with reference to the axis, each pair of projections defining a space receiving a respective spring arm.

15. The spring element according to claim 14 wherein the adjusting ring further includes a tongue disposed between the projections of each pair of projections and arranged to press against the respective spring arm.

16. The spring element according to claim 14 wherein the bearing disc support includes a central opening, the support body including a toggle disposed in the central opening for enabling the base body to be manually rotated.

17. The spring element according to claim 16 further including a locking mechanism for frictionally locking the support body in respective rotational positions thereof.

18. The spring element according to claim 17 wherein the locking mechanism comprises angularly spaced protrusions in one of the base body and the support body and angularly spaced openings in the other of the base body and the support body.

19. The spring element according to claim 18 wherein the protrusions and openings are formed in the support ring and the bearing disc support.

20. The spring element according to claim 13 wherein the bearing disc support includes a recess, a mattress lifter including a lifter back disposed in the recess and a spring for biasing the lifter back out of the recess in a direction away from the bearing ring support.

21. The spring element according to claim 20 wherein the mattress lifter includes two arc-shaped lifter backs disposed in respective arc-shaped recesses formed in the bearing disc support, the spring comprises two arm springs connecting the lifter backs to the bearing disc support.

22. The spring element according to claim 21 wherein the bearing disc support includes a plurality of pins, each pin being connected to an end of an arm spring and to an end of a spring arm.

* * * * *